US006217387B1

(12) United States Patent
Sawada et al.

(10) Patent No.: US 6,217,387 B1
(45) Date of Patent: Apr. 17, 2001

(54) TERMINAL FITTING FOR A WEDGE-BASE BULB AND A BULB SOCKET COMPRISING SUCH A TERMINAL FITTING

(75) Inventors: Hisashi Sawada; Masaki Okamoto, both of Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/223,539

(22) Filed: Dec. 30, 1998

(30) Foreign Application Priority Data

Jan. 9, 1998 (JP) ..... 10-003353
Apr. 23, 1998 (JP) ..... 10-113067

(51) Int. Cl.[7] ..... H01K 1/00
(52) U.S. Cl. ..... 439/619; 439/699
(58) Field of Search ..... 439/619, 856, 439/699.1, 699.2, 751, 752, 752.9, 857

(56) References Cited

U.S. PATENT DOCUMENTS 5,080,615 1/1992 Kondo ..... 439/699
5,286,223 * 2/1994 Ogawa ..... 439/619
5,876,249 * 3/1999 Kim ..... 439/619

FOREIGN PATENT DOCUMENTS 2-150688 12/1990 (JP) .

* cited by examiner

*Primary Examiner*—Brian Sircus
*Assistant Examiner*—Hae Moon Hyeon
(74) *Attorney, Agent, or Firm*—Anthony J. Casella; Gerald E. Hespos; Michael J. Porco

(57) ABSTRACT

A high strength terminal fitting 30 for a wedge-base bulb is provided which is not likely to be deformed while being assembled into a bulb socket. The terminal fitting 30 is provided with a pair of holding pieces 35, and a tab 31 formed by bending a portion of one holding piece 35R to have a steplike shape is provided with a tab side portion 38 extending toward the other holding piece 35L. A first small projection 39A of a receiving portion 39 formed by bending the other holding piece 35L1 is placed on the upper surface of the tab side portion 38. Even if the tab side portion 38 continuous with the tab 31 tries to undergo an upward displacement upon being subjected to an insertion resistance which acts during the insertion of the tab 31 into a tab mount hole 25 formed in a bulb socket 20, the first small projection 39A of the receiving porion 39 restricts the upward displacement of the tab side portion 38, thereby preventing the deformation thereof.

9 Claims, 17 Drawing Sheets

TERMINAL FITTING FOR A WEDGE-BASE BULB AND A BULB SOCKET COMPRISING SUCH A TERMINAL FITTING

BACKGROUND OF THE INVENTION

1. Field of the Invention

The present invention relates to a terminal fitting for a wedge-base bulb (base-free bulb) and to a bulb socket comprising such a terminal fitting.

2. Description of the Prior Art

A known terminal fitting for a wedge-base bulb is disclosed in Japanese Unexamined Utility Model Publication No. 2(HEI)-150688. This terminal fitting 1 is, as shown in FIG. 15, provided with a pair of holding pieces 2 formed by bending opposite sides of a metal sheet at right angles, and a tab 3 formed by bending a bottom end of one holding piece 2R to have a steplike shape. A stepped portion 3A of the tab 3 is formed with a tab side portion 4 extending toward the other holding piece 2L. The tab side portion 4 is placed on the upper surface of a receiving portion 5 formed by bending a bottom end of the other holding piece 2L toward the tab 3. Further, the leading end of the tab side portion 4 is locked in a lock groove 6 provided at the bottom end of the other holding piece 2L. As shown in FIG. 16, the tab 3 is assembled into a bulb socket 7 by being pressed into a tab mount hole 8 formed in the bulb socket 7.

The tab 3 is subjected to a large insertion resistance while being pressed into the tab mount hole 8. Since the tab side portion 4 is placed on the upper surface of the receiving portion S in the terminal fitting 1, the insertion resistance is received only by the lock groove 6 in a position distanced from the tab 3 without being received by the receiving portion 5. Thus, a large moment acts on the tab side portion 4, with the result that it may be bent as shown in FIG. 17.

In view of the above problem, an object of the present invention is to provide a high strength terminal fitting for a wedge-base bulb which is not likely to be deformed while being assembled into a bulb socket and a bulb socket comprising such a terminal fitting.

SUMMARY OF THE INVENTION

According to the invention, there is provided a terminal fitting for a wedge-base bulb in which a pair of holding pieces for substantially holding a base section of a wedge-based bulb are formed by bending opposite sides of a metal plate at an angle different from 0° or 180°, preferably at substantially right angles. A lower end portion of one holding piece is bent to have a substantially steplike shape, thereby forming a tab adjacent the bottom of the one holding piece. A tab side portion is formed at a stepped portion of the tab by bending the lower end portion of the one holding piece toward the other holding piece. A lower end portion of the other holding piece is bent toward the tab to form a receiving portion, which is placed or is placeable on or at the upper surface of the tab side surface or portion, in particular in the folded state.

Accordingly, since the receiving portion is placed or placeable on or at the upper surface of the tab side portion, the upward displacement of the tab side portion can be restricted, even upon being subjected to an insertion resistance which acts during the insertion of the tab into the tab mount hole. Further, the receiving portion extends toward the tab to receive the insertion resistance near the tab. This prevents, unlike the prior art terminal fitting, a large moment from acting on the tab side portion, thereby preventing the tab side portion from being bendingly deformed. Since the support portion for the tab has a high strength in this terminal fitting, the tab is not deformed during the assembling, and operation efficiency is improved.

According to a further preferred embodiment, there is provided a terminal fitting for a wedge-base bulb in which a pair of holding pieces for holding a base section of a wedge-based bulb are formed by bending opposite sides of a metal plate at right angles. A lower end portion of one holding piece is bent to have a steplike shape, thereby forming a tab. The tab is insertable into a tab mount hole provided in a bulb socket at the bottom of the one holding piece. A tab side portion is formed at a stepped portion of the tab by bending the lower end portion of the one holding piece toward the other holding piece. A lower end portion of the other holding piece is bent toward the tab to form a receiving portion, which is placed on the upper surface of the tab side portion.

Preferably, the receiving portion is elongated and is bent or bendable to hold the tab side portion from substantially below and above, in particular in the folded state.

Accordingly, since the tab side portion is held surroundingly by the receiving portion, it is allowed to have more stability and strength.

A notch may be formed at an end of the receiving portion and a part of the receiving portion is placed or placeable substantially below the tab side portion, in particular in the folded state. Accordingly, since the tab side portion is also pushed from below by the part of the receiving portion, the tab side portion is allowed to have more stability.

The tab mount hole of the bulb socket preferably has a length to accommodate up to a base end of the tab when the insertion of the tab is completed, and/or the tab is formed such that the base end thereof is wider than the other portion thereof. Accordingly, since the diameter of the tab mount hole can be widened according to the width of the wide base end of the tab, a portion of the tab toward the leading end which is narrower than the base end can be inserted into the tab mount hole while leaving a margin. As a result, the terminal fitting can be inserted more easily and operational efficiency can be improved. Further, strength can be enhanced by widening the base end of the tab, thereby preventing a deformation.

The holding pieces preferably are formed by bending a metal plate along bending lines by an angle different from 0° or 180°, preferably substantially at right angles, such that the holding pieces are connected via a base plate. The tab side portion that is formed on the tab by bending the one holding piece is supported by the receiving portion that is formed on the other holding piece.

According to the invention, there is further provided a bulb socket for a wedge-base bulb comprising at least one terminal fitting as described above. The bulb socket further comprises a housing having a bulb receptacle for at least partially housing a base section of a wedge-based bulb and a connector receptacle for at least partially housing a mating connector. The terminal fitting is at least partially arranged in the bulb receptacle for its connection to the bulb and the tab is insertable into a tab mount hole provided in the housing so that a portion of the tab projects into the connector receptacle for its connection with the mating connector. According to a preferred embodiment of the invention, the tab mount hole has a length to accommodate only up to a base end of the tab when the insertion of the tab is completed.

Preferably, a base end of the tab is widened to the degree that it is still insertable into the tab mount hole and a portion of the tab toward its leading end is narrower than the base end such that it is insertable into the tab mount hole while leaving a margin. Accordingly, the insertion of the tab is easier and the operation efficiency is improved.

These and other objects, features and advantages of the present invention will become more apparent upon a reading of the following detailed description and accompanying drawings.

DETAILED DESCRIPTION OF THE PREFERRED EMBODIMENTS

Figure 1:
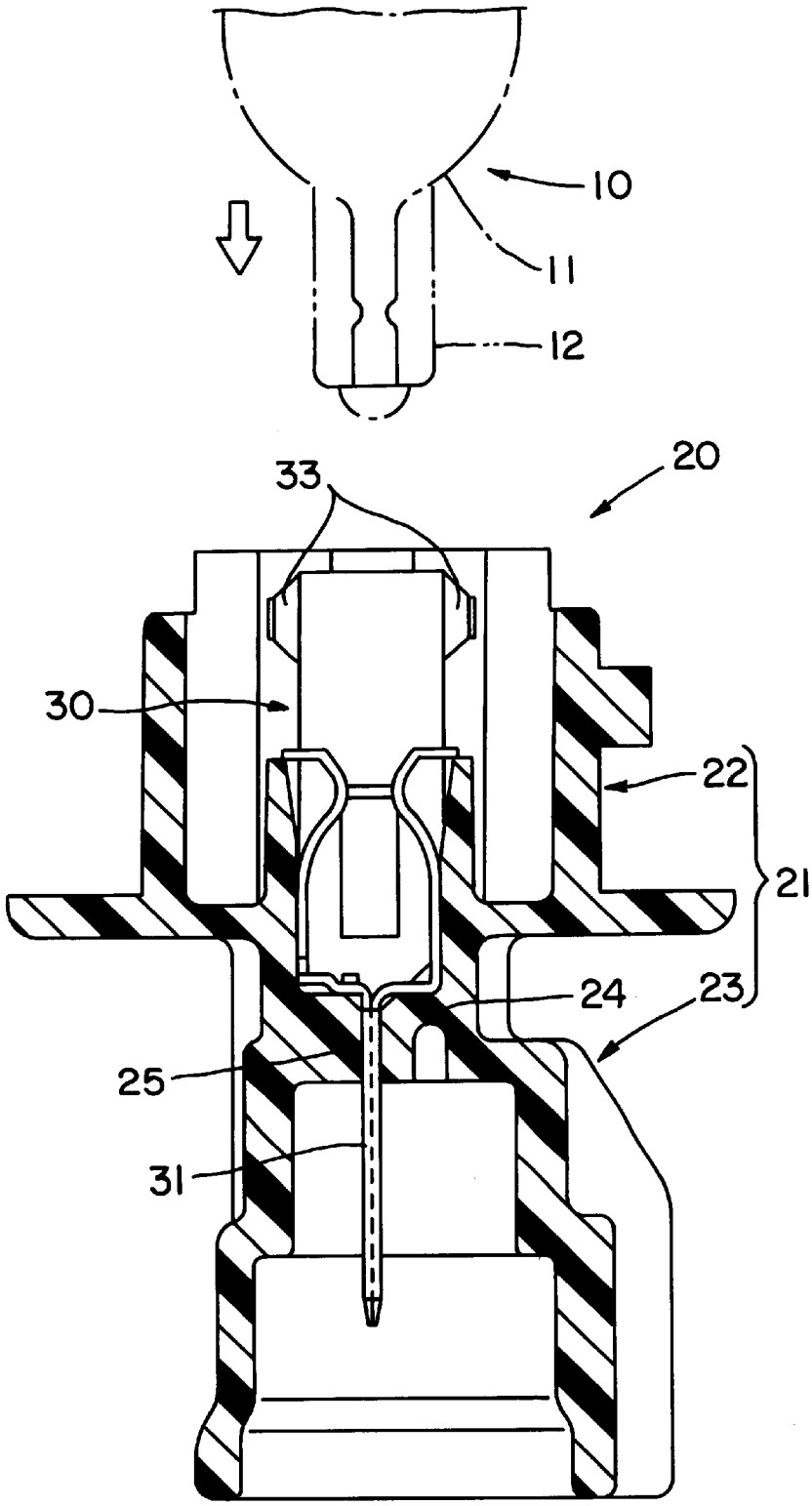
FIG. 1 is a side section of a bulb socket.
Figure 2:
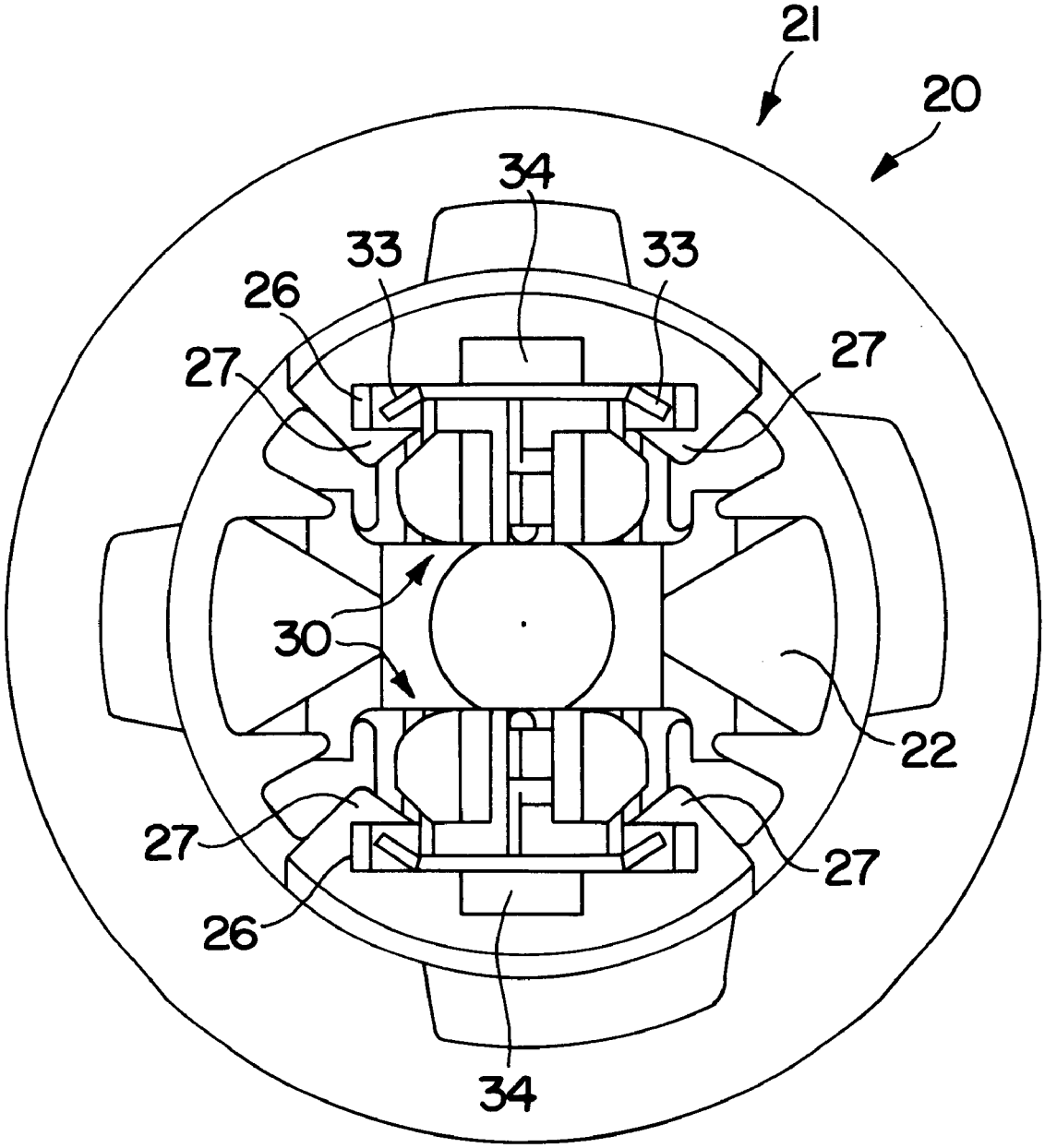
FIG. 2 is a plan view of the bulb socket.

One embodiment of the invention is described with reference to FIGS. 1 to 8. More particularly, a wedge-base bulb 10 (hereinafter, "bulb 10") is partly shown in FIG. 1, and is shaped such that a flat base section 12 is provided substantially continuously at the bottom end of a hollow light emitting portion 11 preferably substantially in the form of a cylinder (the bottom side is the side substantially opposed to the side where the bulb 10 is inserted into the bulb socket 20 or between holding pieces 35 to be described later). Lead wires (not shown) from filaments (not shown) accommodated in the light emitting portion 11 are drawn from the bottom surface of the base section 12 and folded back at the opposite surfaces of the base section 12 to form a contact or contact portions.

A bulb socket 20, as shown in FIG. 1, is provided with a bulb receptacle 22 which is open toward a first side, and preferably toward the upper side, of a housing 21 that preferably is made of a synthetic resin. The base section 12 of the bulb 10 is insertable into the bulb socket 20. A connector receptacle 23 is open toward a second side of the housing 21, and is arranged at an angle different from 0° with respect to the first side. The connector receptacle 23 is preferably at about 180° (i.e. substantially opposed) to the bulb socket 20, and most preferably is substantially on the lower side of the housing 21. An unillustrated mating connector is insertable into the connector receptacle 23. The bulb receptacle 22 and the connector receptacle 23 are substantially continuously or unitarily or integrally formed and are partitioned by a partition wall 24 provided in the housing 21. A tab mount hole 25 is formed to extend through the partition wall 24, and a tab 31, provided on a terminal fitting 30 to be described later, is pressed or inserted into the tab mount hole 25. The leading end of the tab 31 at least partially projects into the connector receptacle 23, preferably through its back surface so as to be electrically connectable with a mating terminal fitting of the mating connector.

Figure 5:
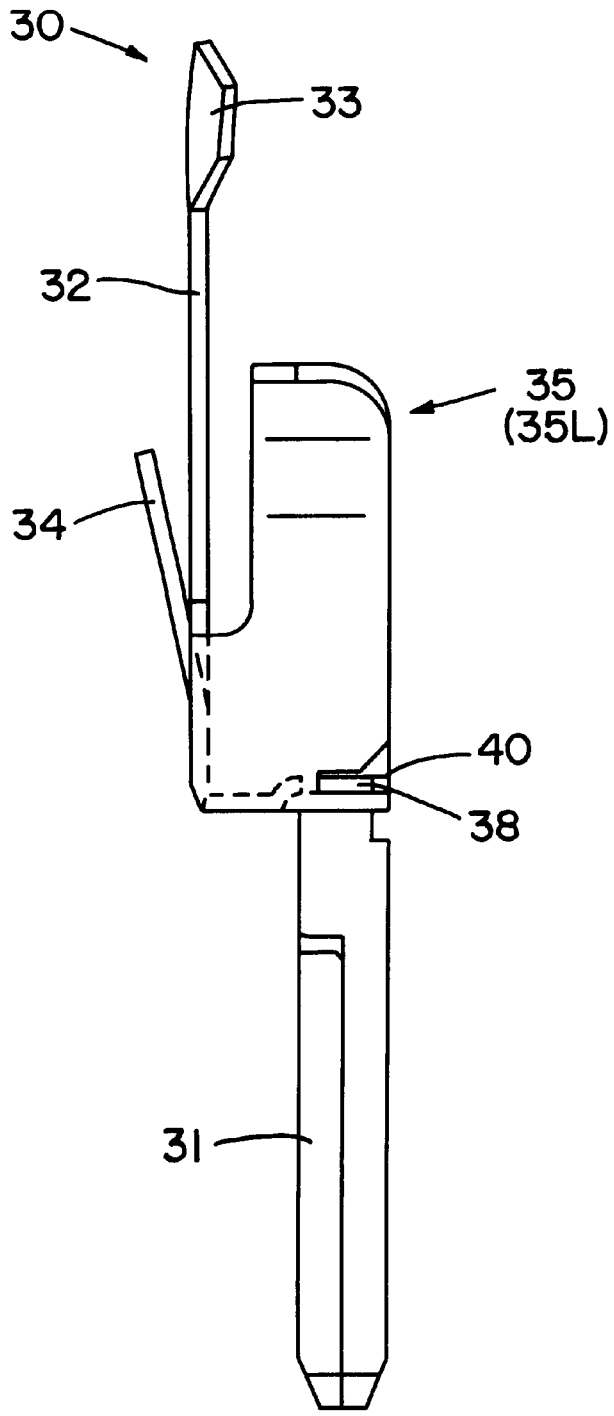
FIG. 5 is a side view of the terminal fitting when viewed in a direction of arrow A of FIG. 4.
Figure 6:
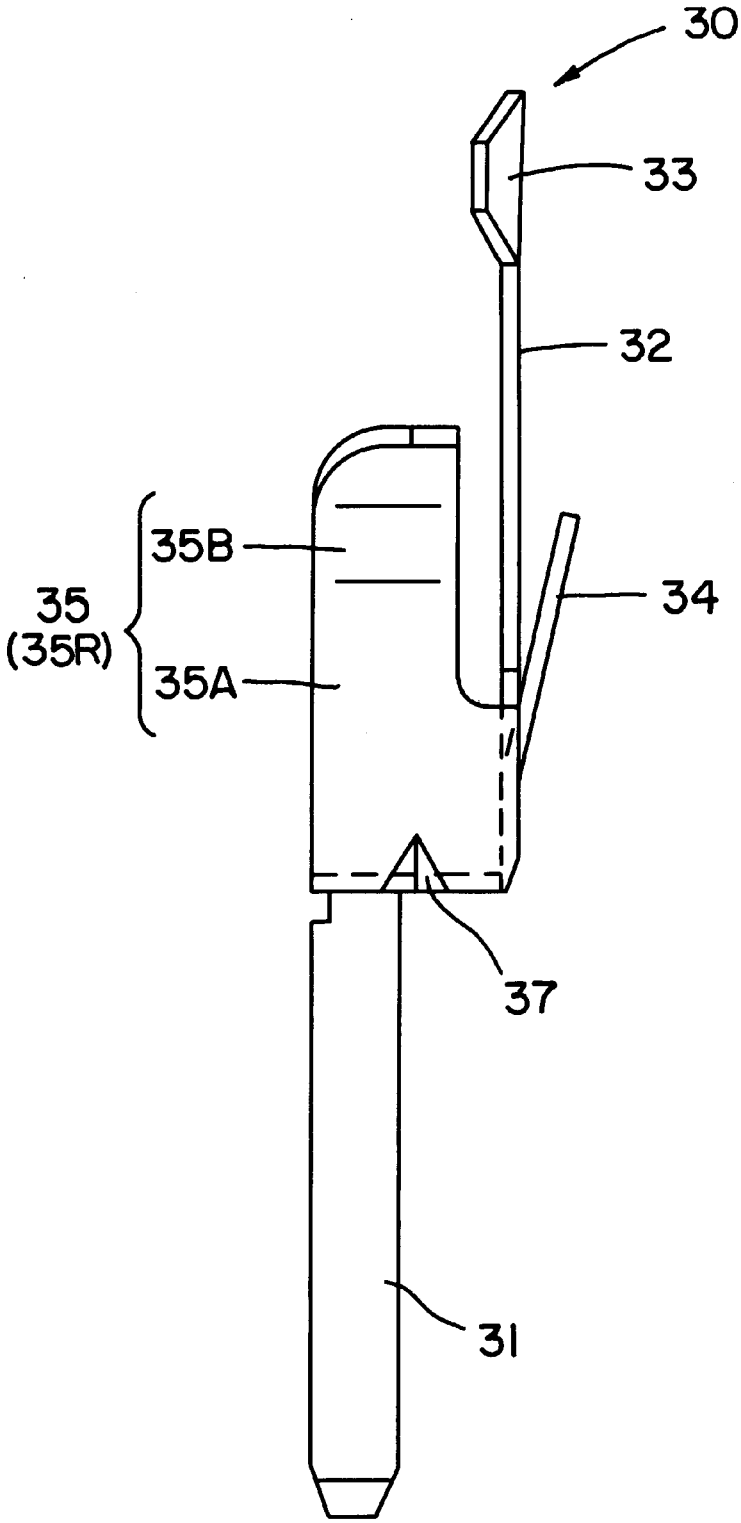
FIG. 6 is a side view of the terminal fitting when viewed in a direction of arrow B of FIG. 4.

A pair of terminal fittings 30 are accommodated substantially opposite to each other (see FIG. 2) in the bulb receptacle 22. The terminal fitting 30 is entirely shown in FIG. 3 and is provided with a long substantially flat base plate 32. The base plate 32 is or can be accommodated in an accommodation groove 26 (see FIG. 2) formed in the inner circumferential surface of the bulb receptacle 22. A pair of bulging or projecting portions 33 preferably are provided at the substantially opposite sides of an upper or distal end of the base plate 32, and are or can be lockingly engaged with concealing walls 27 (see FIG. 2) that project inwardly from the opposite sides of the accommodation groove 26 so as to substantially retain or position the terminal fitting 30 in the bulb receptacle 22. As shown in FIG. 5, a locking portion 34 extends substantially obliquely upwardly or at an angle different from 0° or 180° with respect to the base plate 32 and is formed in the rear surface of the base plate 32 by cutting and bending a portion of the base plate 32. This locking portion 34 is locked or lockable with an engaging portion (not shown) formed in the inner surface of the bulb receptacle 22, thereby holding or positioning the terminal fitting 30 so as not to come out.

Figure 3:
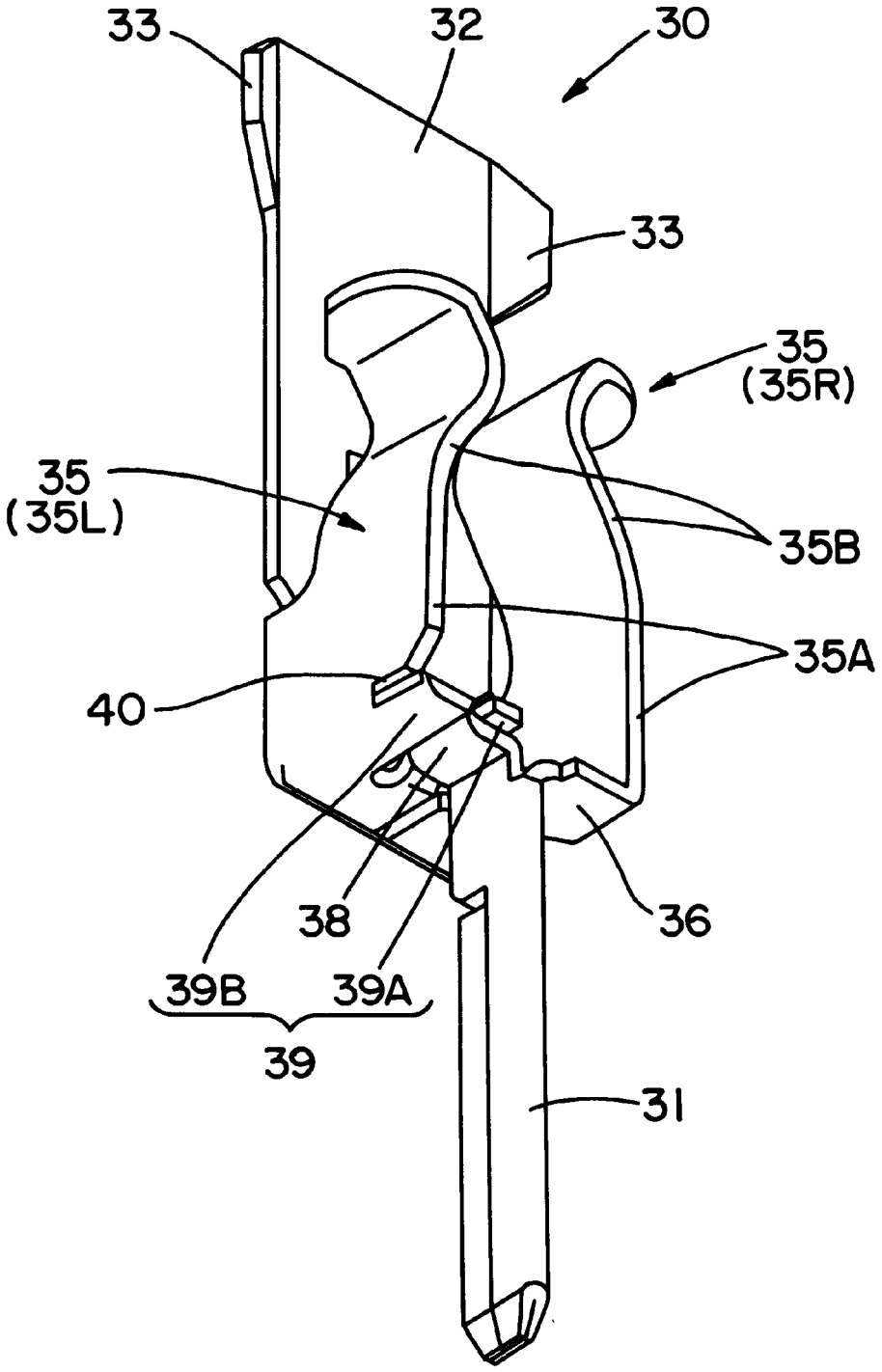
FIG. 3 is a perspective view of a terminal fitting according to one embodiment of the invention.

Preferably at the bottom end of the base plate 32, a pair of holding pieces 35 are provided substantially opposite to each other. The holding pieces 35 are, as shown in FIG. 3, such that base portions 35A thereof are bent at an angle different from 0° or 180°, preferably at substantially right angles to the opposite sides of the base plate 32 and free ends 35B thereof extend upwardly from the base portions 35A. The leading ends of the free ends 35B are bent toward each other so as to elastically hold the base section 12 of the bulb 10. The holding pieces 35 may be provided laterally projecting from the base plate 32.

Figure 4:
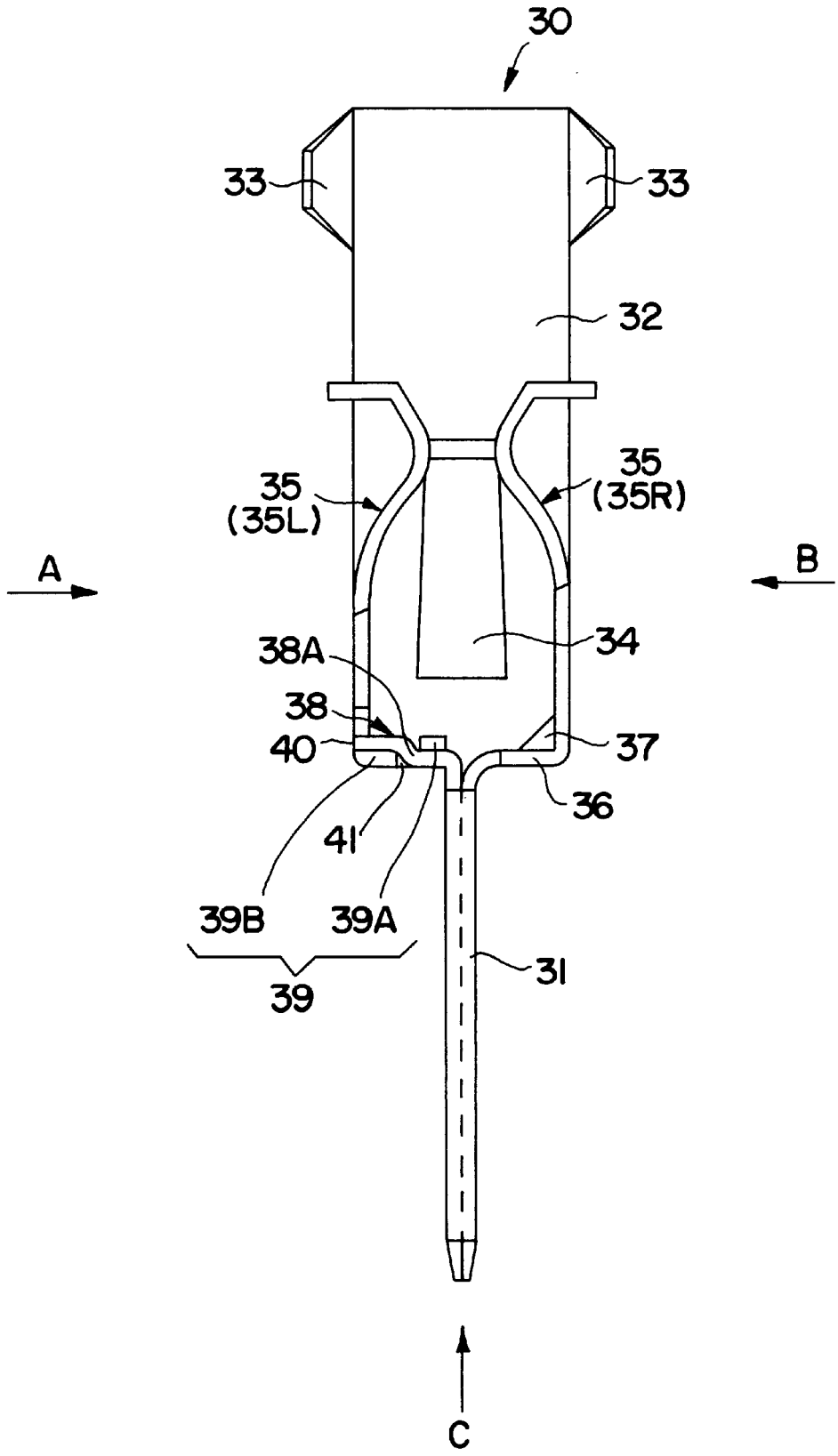
FIG. 4 is a front view of the terminal fitting.
Figure 7:
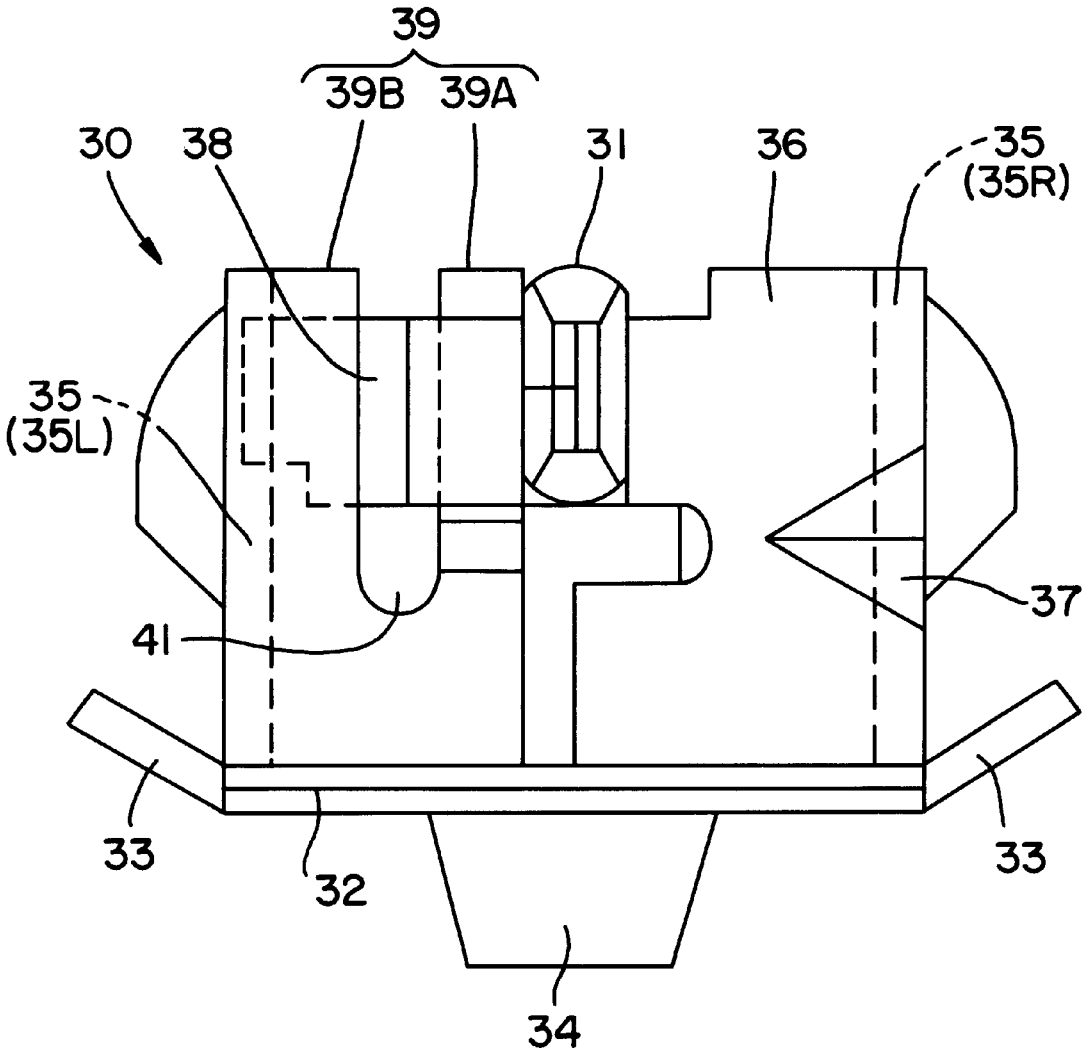
FIG. 7 is a bottom view of the terminal fitting when viewed in a direction of arrow C of FIG. 4.

A lower part of the right holding piece 35R in FIG. 4 is bent toward the left holding piece 35L and then downwardly to have a steplike shape. This downwardly extending portion serves as a flat tab 31. A stepped portion 36 and the holding piece 35R are partially coupled by an obliquely extending and rib-shaped embossed portion 37 (see FIG. 4) to enhance a strength. The tab 31 is suspended from a side of the stepped portion 36 away from the base plate 32 as shown in FIG. 7 and preferably is formed by putting two metal plates together as shown in FIG. 4. The left one of the metal plates is bent to project substantially symmetrically with the stepped portion 36, thereby forming a tab side portion or connection portion 38. The tab side portion 38 has its intermediate portion bent moderately upward as shown in FIG. 4 and its leading end fitted in a lock groove 40 (see FIG. 3) formed at the bottom end of the left holding piece 35L.

On the other hand, a lower portion of the left holding piece 35L in FIG. 4 is bent at an angle different from 0° or 180°, preferably at a substantially right angle to the right holding piece 35R to form a receiving portion 39. The receiving portion 39 is formed with a slit 41 which is open at a side substantially opposite from the base plate 32 or at a side of the tab 31 and extends to a substantially middle position with respect to its widthwise direction as shown in FIG. 7, and first and second small projections 39A, 39B are formed at the opposite sides of the slit 41. As shown in FIG. 4, the first small projection 39A at the right side of the slit 41 is placed on the base side of the tab side portion 38, and the second small projection 39B at the left side of the slit 41 is placed below the leading end of the tab side portion 38 or the first and second small projections 39A, 39B project in substantially opposed directions.

Figure 8:
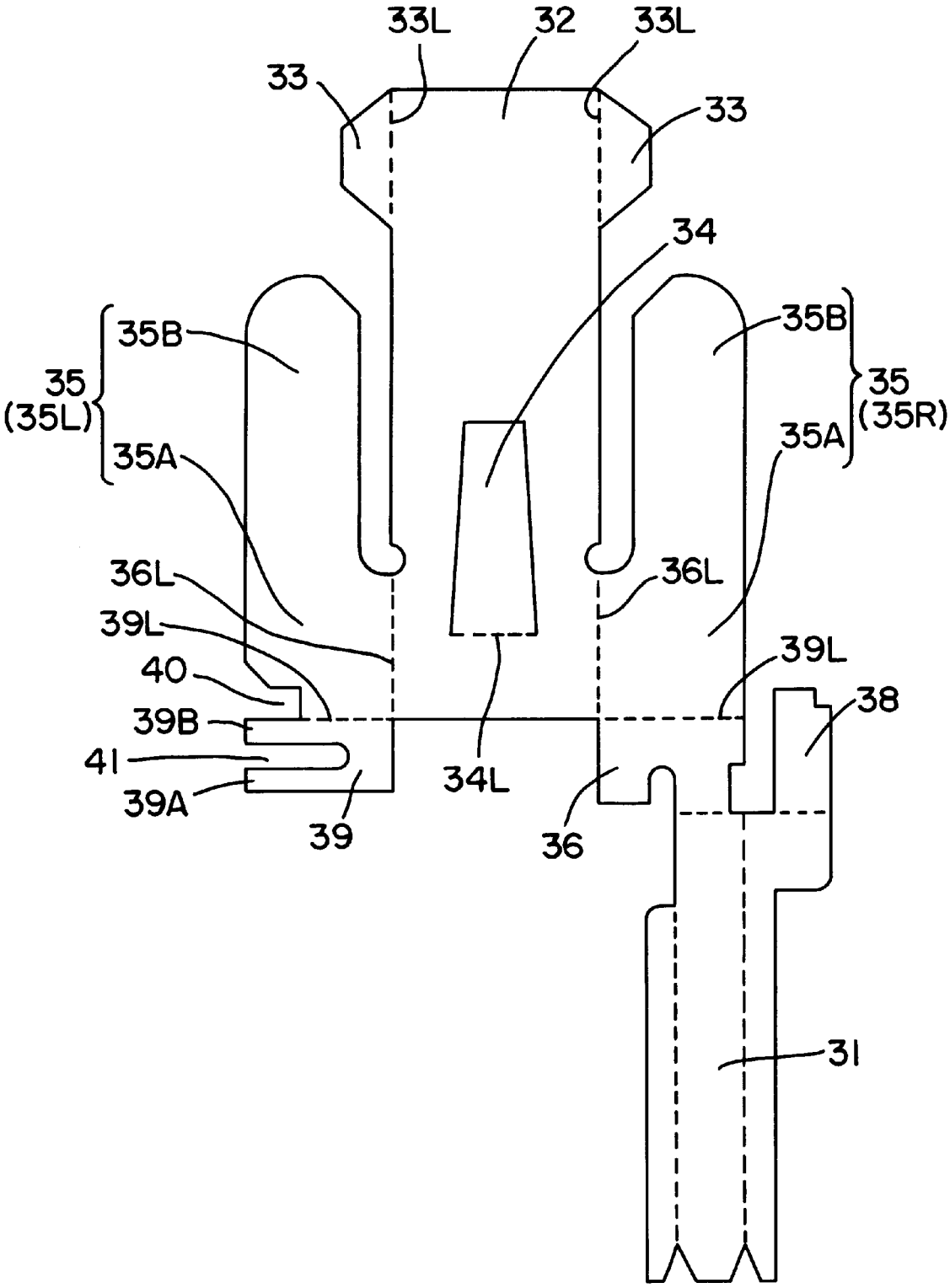
FIG. 8 is a development of the terminal fitting according to the first embodiment of the invention.

A blank of metal, or development of the terminal fitting, according to the invention is shown in FIG. 8. Corresponding portions of the development are identified by the same reference numerals. The terminal fitting according to this embodiment is completed by bending the respective portions along broken lines 33L, 34L, 36L, 39L (shown in FIG. 8) by bending angles different from 0° or 180°, wherein the bending angles along the lines 33L and 34L are preferably comprised between 20° and 60°, whereas the bending angles along the lines 36L and 39L are preferably about 90°.

To assemble the terminal fitting 30 into the bulb socket 20, the tab 31 is pushed into the tab mount hole 25 formed in the housing 21 by gripping the base plate 32 of the terminal fitting 30. Then, a force acts on the tab 31 in such a manner as to push the tab 31 into a clearance between the holding pieces 35 due to an insertion resistance (or due to a deflection resistance caused by the elastic bending strength of the holding pieces 35), and the tab side portion 38 substantially continuous with the tab 31 tries to undergo an upward displacement. However, since the first small projection 39A of the receiving portion 39 is placed on the upper surface of the tab side portion 38 in the terminal fitting 30 of this embodiment, the upward displacement of the tab side portion 38 is restricted, thereby substantially preventing a deformation thereof. Further, the first small projection 39A pushes a portion of the tab side portion 38 near the tab 31 from above. This prevents a large moment from acting on the tab side portion 38 and, accordingly, prevents the tab side portion 38 from being bendingly deformed. Furthermore, since the tab side portion 38 is pushed from below by the second small projection 39B of the receiving portion 39, the tab side portion 38 is allowed to have more stability and strength.

As described above, since the support portion of the tab 31 has a high strength in the terminal fitting 30 of this embodiment, the tab 31 is not deformed while the terminal fitting 30 is assembled into the bulb socket 20, which leads to a better operation efficiency.

Figure 14:
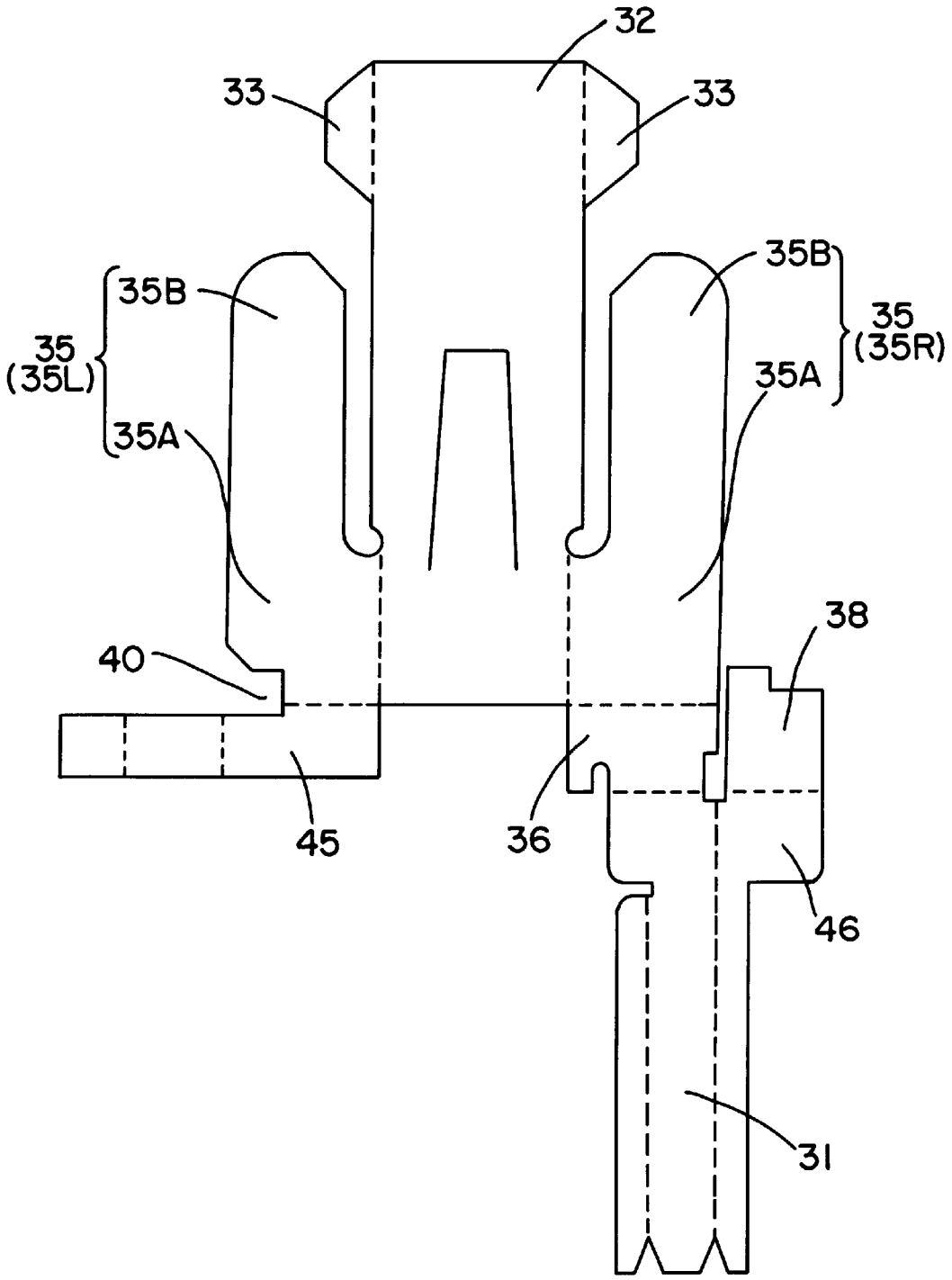
FIG. 14 is a development of the terminal fitting according to the second embodiment of the invention.
Figure 15:
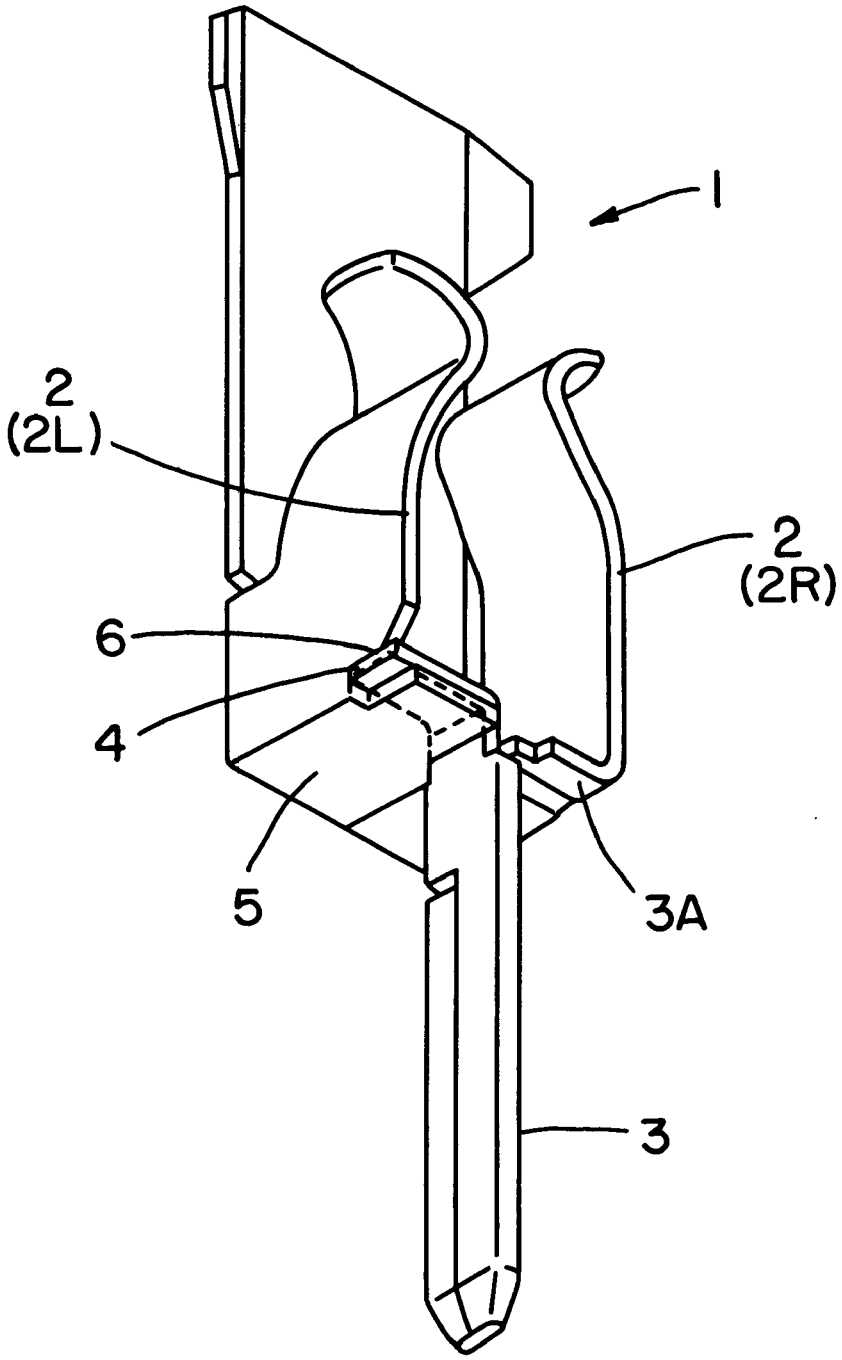
FIG. 15 PRIOR ART
FIG. 15 is a perspective view of a prior art terminal fitting for a bulb socket.
Figure 16:
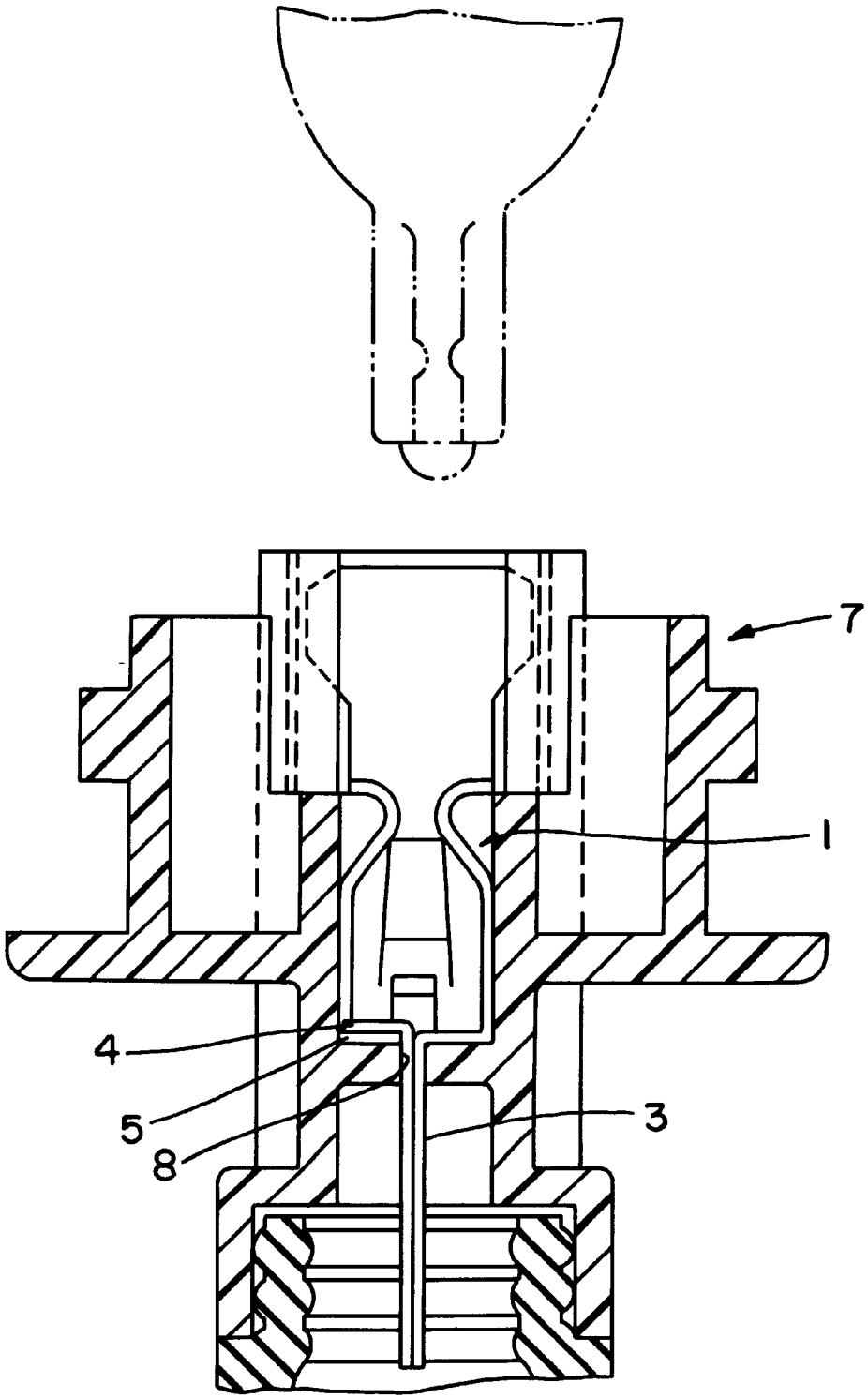
FIG. 16 PRIOR ART
FIG. 16 is a section of prior art bulb socket and terminal fitting.
Figure 17:
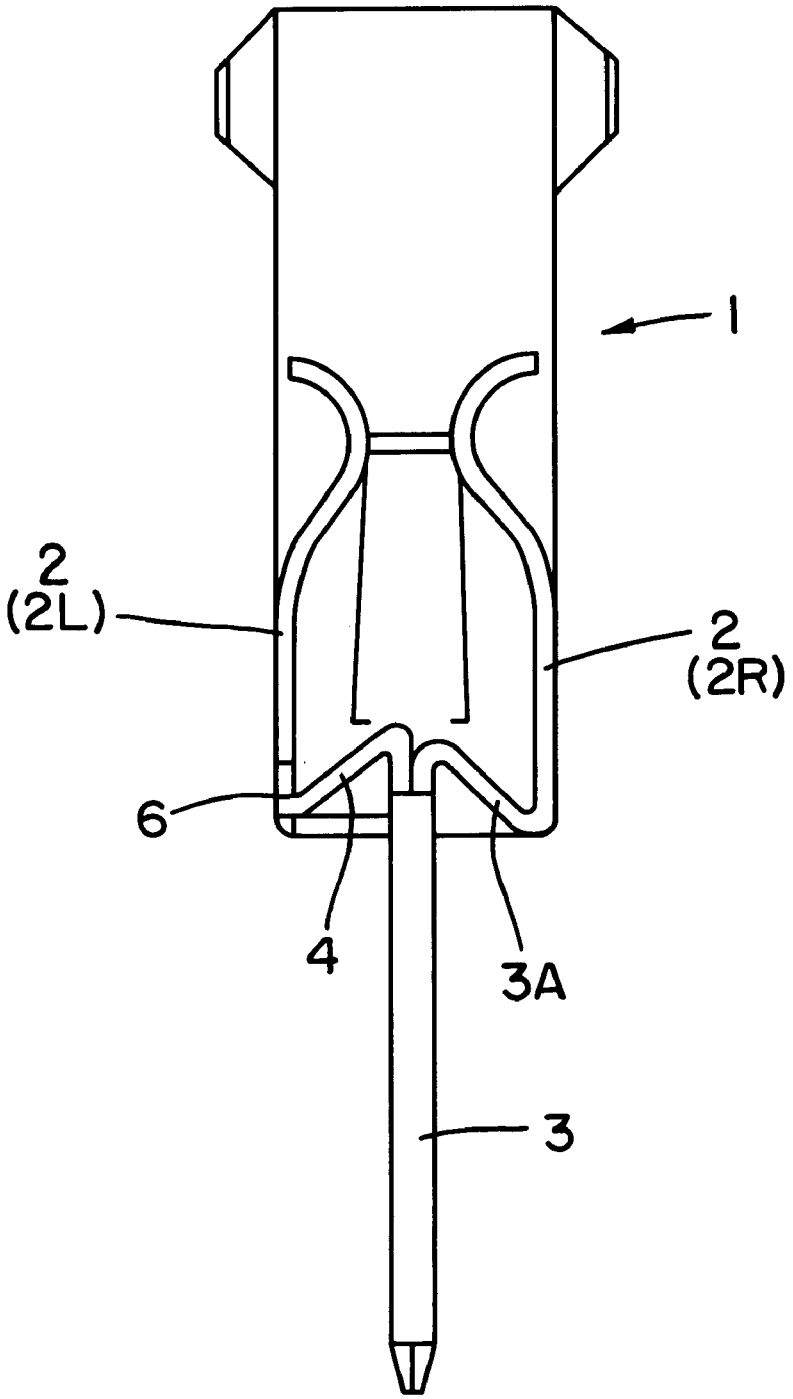
FIG. 17 PRIOR ART
FIG. 17 is a front view of the prior art terminal fitting in its deformed state.

A second embodiment of the invention is described with reference to FIGS. 9 to 14. The terminal fitting 30 according to this embodiment is constructed such that the tab side portion 38 is held substantially surroundingly by a receiving portion 45 from above and below. The receiving portion 45 is strip-shaped in its developed state as shown in FIG. 14. The receiving portion 45 at least partially covers the lower surface of the tab side portion 38 by its base end side, is folded up at the edge of the tab side portion 38 to at least partially cover the upper surface of the tab side portion 38, and preferably has its leading end bent between the tab side portion 38 and the base plate 32. In this way, the tab side portion 38 is fixed by being held surroundingly by the receiving portion 45.

As can be seen by the comparison of FIGS. 8 and 14, the tab side portion 38 of this embodiment is substantially wider than the of the first embodiment. This is because the width of the side tab portion 38 of the first embodiment is restricted by the slit 41 unlike that of the second embodiment since it is surrounded by the receiving portion 45.

Figure 9:
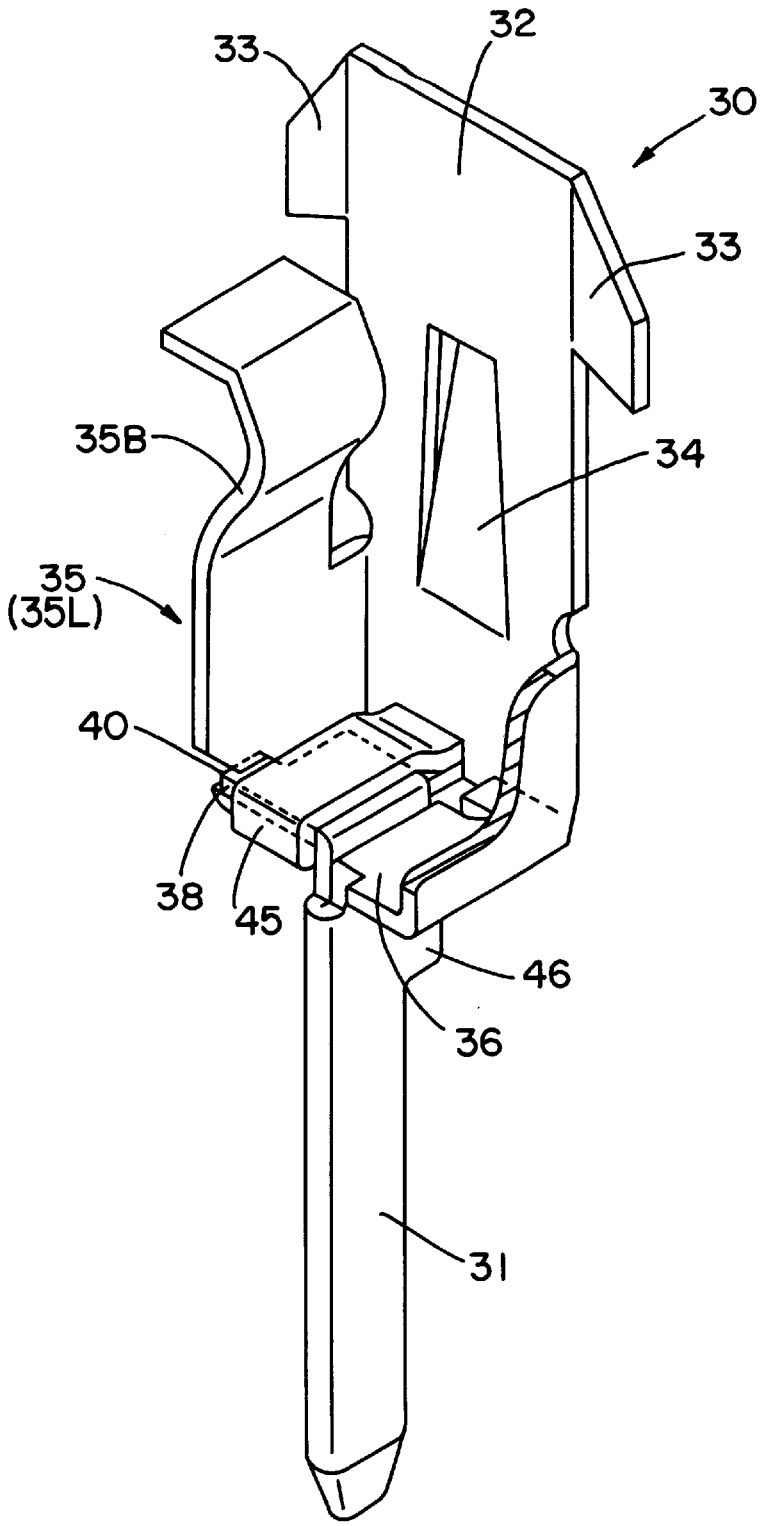
FIG. 9 is a perspective view in section of a terminal fitting according to a second embodiment of the invention.
Figure 10:
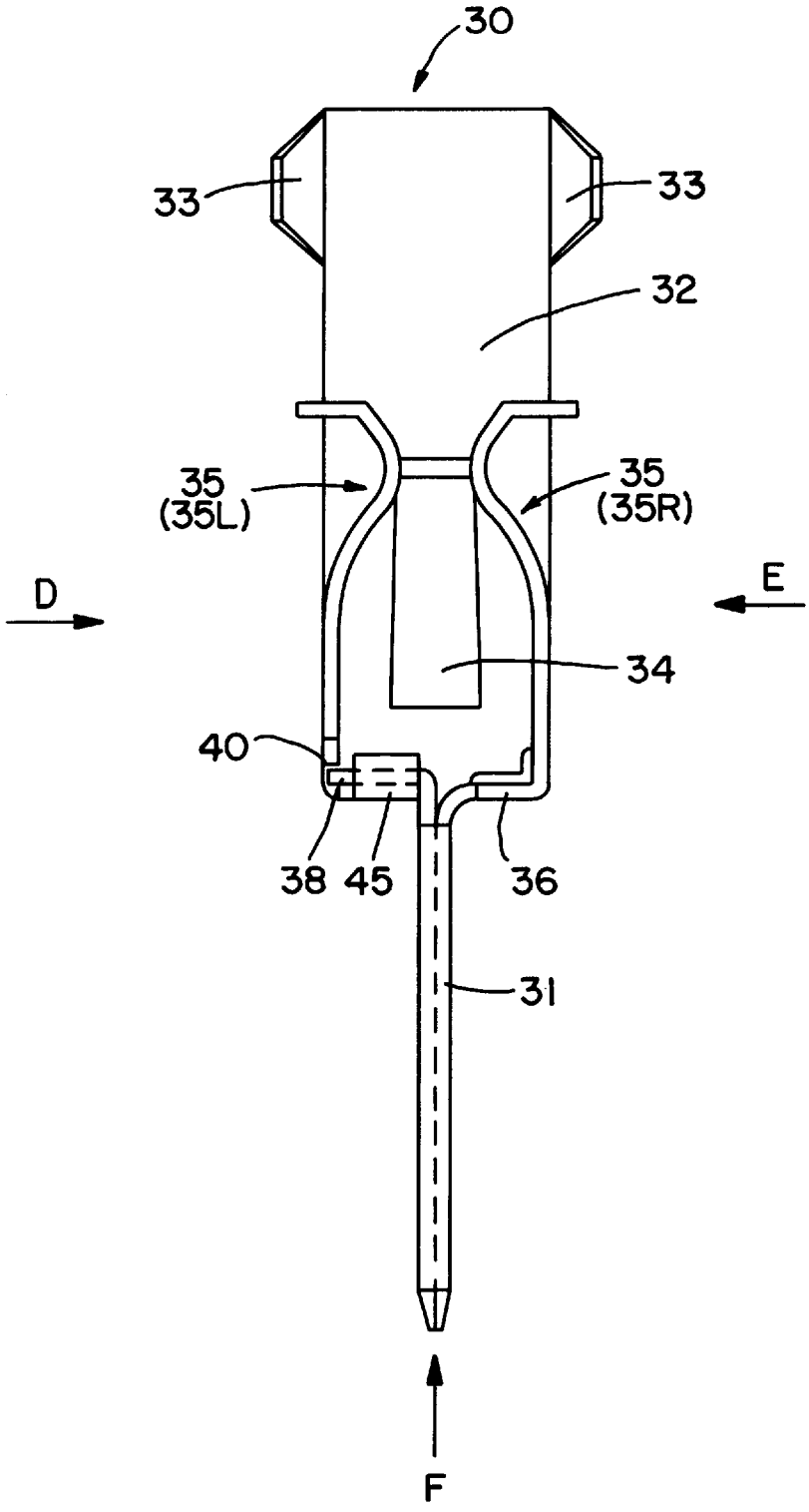
FIG. 10 is a front view of the terminal fitting.
Figure 11:
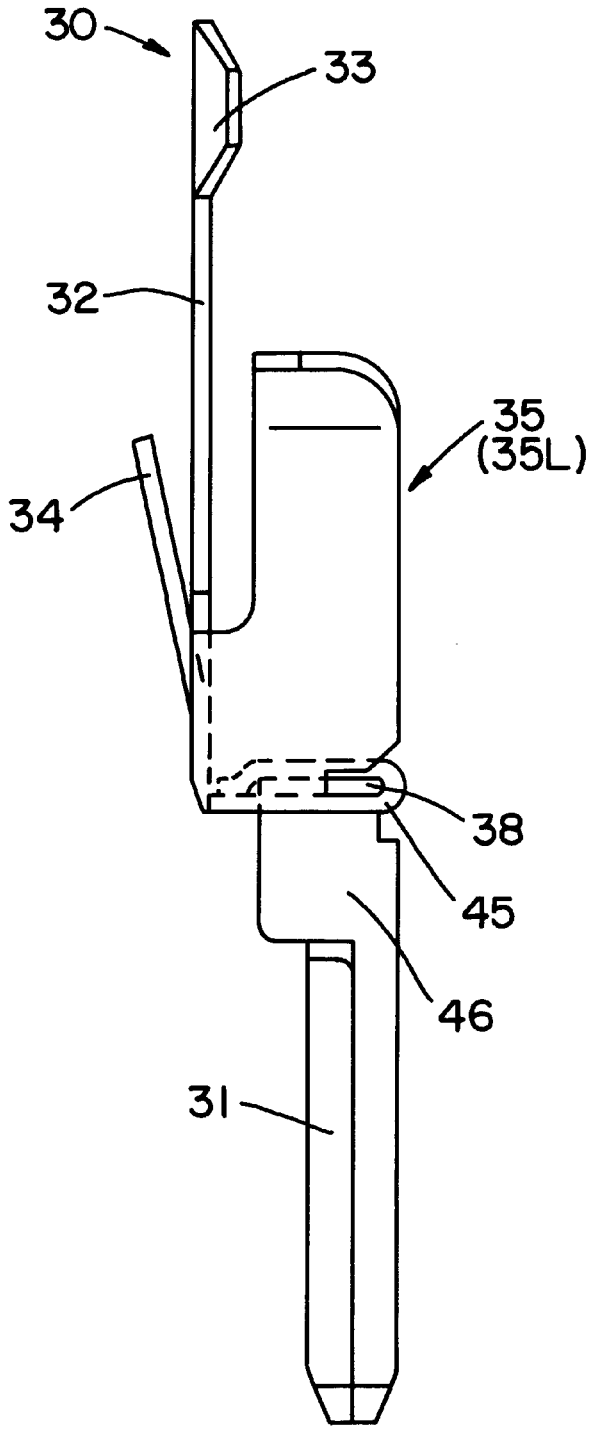
FIG. 11 is a side view of the terminal fitting when viewed in a direction of arrow D of FIG. 10.
Figure 12:
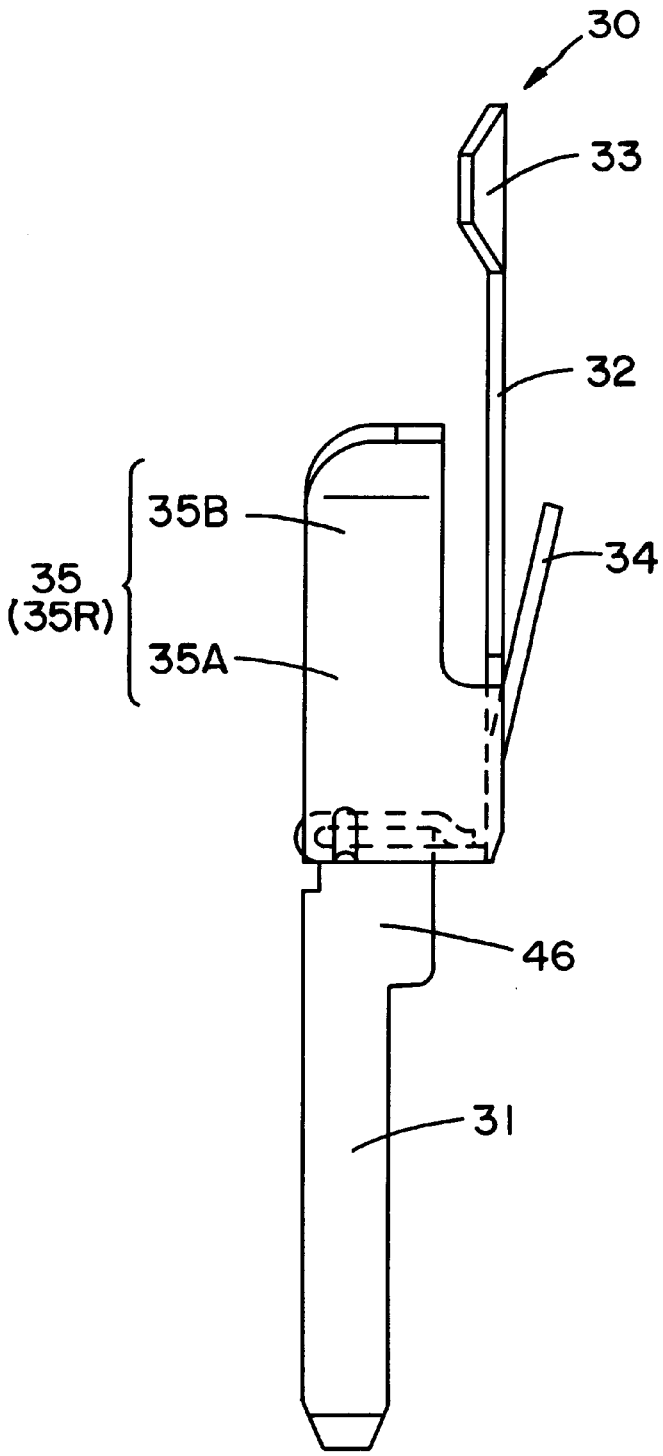
FIG. 12 is a side view of the terminal fitting when viewed in a direction of arrow E of FIG. 10.
Figure 13:
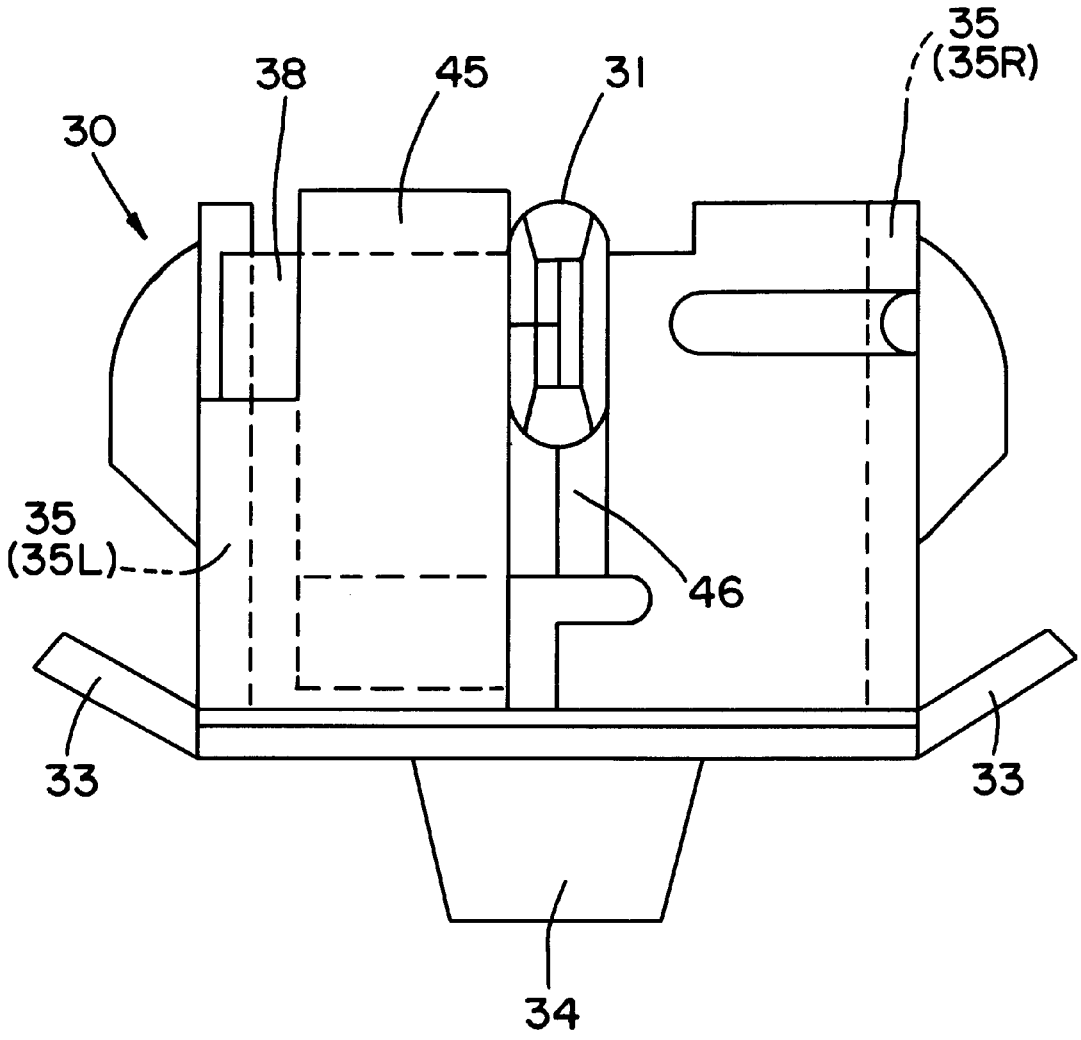
FIG. 13 is a bottom view of the terminal fitting when viewed in a direction of arrow F of FIG. 10.

In the terminal fitting 30 of this embodiment, a base end 46 of the tab 31 is stepped so as to be wider than the other portion as shown in FIG. 9. The base end 46 has the same width as the tab side portion 38 as shown in FIG. 14 and is continuous with the tab side portion 38 and the stepped portion 36. When the tab 31 is inserted to the bottom of the tab mount hole 25 (see FIG. 1) formed in the bulb socket 20, the base end 46 of the tab 31 is accommodated in the tab mount hole 25.

Since the other construction is similar to the foregoing embodiment, no description is given thereon by identifying the same elements by the same reference numerals.

Since the tab side portion 38 is at least partially surrounded by the receiving portion 45 in the terminal fitting 30 of this embodiment, the receiving portion 45 and the tab side portion 38 can firmly be fixed. Accordingly, a force transmitted from the tab 31 to the tab side portion 38 when the terminal fitting 30 is assembled into the bulb socket 20 can be received by the receiving portion 45. As a result, the terminal fitting 30 is allowed to have more stability and strength.

Further, since the base end 46 of the tab 31 is widened and made substantially continuous with the stepped portion 36 and the tab side portion 38, the tab 31 can be supported with a larger strength. Particularly in the second embodiment, the width of the tab side portion 38 is not subject to restriction by surrounding the tab side portion 38 by the receiving portion 45. Thus, the tab side portion 38 and the base end 46 of the tab 31 can be made substantially continuous while having the same width, and a strength between the tab side portion 38 and the tab 31 can be enhanced.

Furthermore, since only the base end 46 of the tab 31 is widened and this base end 46 is made still insertable into the tab mount hole 25 of the bulb socket 20, a portion of the tab 31 toward its leading end which is narrower than the base end 46 is insertable into the tab mount hole 25 while leaving a margin. This makes the insertion of the tab 31 easier and leads to an improvement in operation efficiency.

Further, operability is good since the tab side portion 38 and the receiving portion 45 are fixed by only surrounding the tab side portion 38 by the receiving portion 45 in a process of assembling the terminal fitting 30.

The present invention is not limited to the described and illustrated embodiment, but the following embodiment also is embraced by the technical scope of the present invention as defined in the claims. Besides the following embodiment, a variety of other changes can be made without departing from the scope and spirit of the invention as defined in the claims.

Although the tab side portion 38 is supported also from below by the second small projection 39B in the foregoing embodiment, it may be supported only from above by the receiving portion.

Although the receiving portion 45 of the second embodiment surrounds the tab side portion 38 from below, it may do so from above.

What is claimed is:

1. A terminal fifting for a wedge-base bulb having a base section, the terminal fitting comprising:

a metal plate having opposite sides, first and second holding pieces bent toward one another from the opposite sides of the metal plate for substantially holding the base section of the wedge-base bulb, each said holding piece having a lower end, a receiving portion extending from the lower end of the second holding piece toward the lower end of the first holding piece, the receiving portion having opposed upper and lower surfaces and a slit dividing said receiving portion into an outer section adjacent the second holding piece and an inner section closer to the first holding piece, a step portion extending from the lower end of the first holding piece toward the second holding piece, a tab having a top end at said stepped portion and a bottom end, a tab side portion extending from said top end of said tab toward said second holding piece, said tab side portion having an upper surface facing upwardly and away from said tab and an opposed lower surface, the upper surface of the tab side portion adjacent the tab being engaged by the lower surface of the inner section of the receiving portion, an intermediate section of the tab side portion being engaged in the slit of the receiving portion and a section of the tab side portion most distant from the tab having the lower surface thereof engaged against the upper surface of the outer section of the receiving portion, whereby the engagement of the upper and lower surfaces of the tab side portion by the respective inner and outer sections of the receiving portion substantially prevents relative movement between the tab and the holding pieces.

2. A terminal fitting according to claim 1, wherein the tab is formed such that the top end thereof is wider than other portions thereof.

3. A terminal fitting according to claim 1, wherein the holding pieces are substantially at right angles to the metal plate.

4. A bulb socket for a wedge-base bulb comprising at least one terminal fitting according to claim 1, further comprising:

a housing having a bulb receptacle for at least partially housing a base section of a wedge-base bulb and a connector receptacle for at least partially housing a mating connector, wherein the terminal fitting is at least partially arranged in the bulb receptacle for its connection to the bulb and wherein the tab is insertable into a tab mount hole provided in the housing so that a portion of the tab projects into the connector receptacle for connection with the mating connector.

5. A bulb socket according to claim 4, wherein the tab mount hole has a length as to accommodate only up to a base end of the tab when insertion of the tab is completed.

6. A bulb socket according to claim 5, wherein a base end of the tab is widened to the degree that it is still insertable into the tab mount hole and wherein a portion of the tab toward its leading end is narrower than the base end such that it is insertable into the tab mount hole while leaving a margin.

7. A terminal fitting for a wedge-base bulb, comprising:

a metal plate having opposite sides, first and second holding pieces bent toward one another from the opposite sides of the metal plate for holding a base section of the wedge-base bulb, each said holding piece having a lower end, a lock groove formed in the lower end of the second holding piece;

a receiving portion extending from the lower end of the second holding piece toward the first holding piece, a step portion extending from the lower end of the first holding piece toward the second holding piece;

a tab having a top end at the step portion and a bottom end;

a tab side portion extending from the top end of the tab toward the second holding piece, the tab side portion having an upper surface facing upwardly and away from the tab and a lower surface, the tab side portion further having a free end and an intermediate portion between the free end and the top end of the tab, the free end of the tab side portion being fitted in the lock groove of the second holding piece; and the receiving portion being deformed such that a first section of the receiving portion tightly engages the lower surface of the intermediate portion of the tab side portion and such that a second section of the receiving portion tightly engages the upper surface of the intermediate portion of the tab side portion.

8. A terminal fitting according to claim 7, wherein the receiving portion includes a slit dividing said receiving portion into an outer section adjacent the second holding piece and an inner section closer to the first holding piece, the outer section of the receiving portion defining the first section which engages the lower surface of the tab side portion, the inner section of the receiving portion being the second section which engages the upper surface of the tab side portion.

9. A terminal fitting according to claim 7, wherein the receiving portion is folded around the tab side portion for tightly engaging substantially the entire lower surface of the intermediate portion of the tab side portion and substantially the entire upper surface of the intermediate portion of the tab side portion.

* * * * *